United States Patent [19]

Papazian

[11] Patent Number: 5,061,328

[45] Date of Patent: Oct. 29, 1991

[54] COATING METHOD TO SUPPRESS POROSITY IN A1-LI ALLOYS

[75] Inventor: John M. Papazian, Great Neck, N.Y.

[73] Assignee: Grumman Aerospace Corporation, Bethpage, N.Y.

[21] Appl. No.: 548,236

[22] Filed: Jul. 5, 1990

[51] Int. Cl.[5] ..... C22F 1/04

[52] U.S. Cl. ..... 148/13.1; 148/11.5 A; 148/240

[58] Field of Search ..... 148/115 A, 13.1, 20, 148/127, 159, 240

[56] References Cited

U.S. PATENT DOCUMENTS 4,786,337 11/1988 Martin ..... 148/13.1

FOREIGN PATENT DOCUMENTS 2137666 10/1984 United Kingdom .

*Primary Examiner*—R. Dean
*Assistant Examiner*—Robert R. Koehler
*Attorney, Agent, or Firm*—Pollock, VandeSande & Priddy

[57] ABSTRACT

An element having a diffusion coefficient at a heat treatment temperature which is greater to or equal than that of lithium is deposited on the external surface of an Al-Li alloy part before heat treatment. During heat treatment the diffusion of lithium atoms out of the alloy material is compensated by the opposite diffusion of the deposited element. Thus, the creation of agglomerated vacancies in the nature of interior pores is eliminated so that a treated part may maintain its structural strength. Typical diffusion materials may be selected from Ag, Au, Zn, Ge, In, Sn, and Tl.

6 Claims, 1 Drawing Sheet

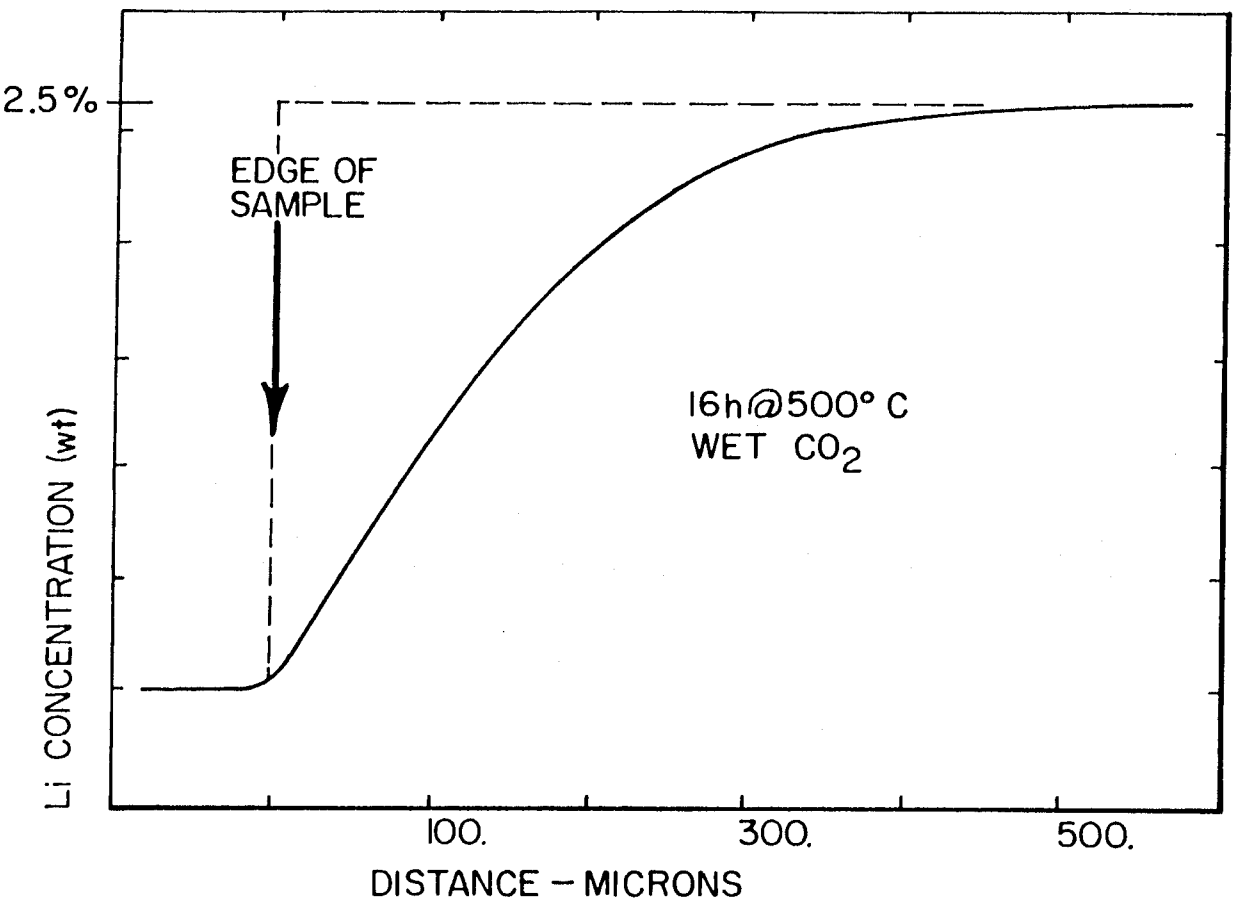
PRIOR ART

COATING METHOD TO SUPPRESS POROSITY IN A1-LI ALLOYS

RELATED APPLICATION

This application is related to my co-pending application Ser. No. 07/583,313, dealing with a superior atmosphere for inhibiting lithium loss in Al-Li alloys.

FIELD OF THE INVENTION

The present invention relates to the heat treatment of Al-Li alloys, and more particularly to a protective measure for suppressing lithium loss during heat treatments.

BACKGROUND OF THE INVENTION

During recent years Al-Li alloys have become metals of great interest in the aerospace industry due to their extreme light weight. However, in order for these metals to achieve necessary strength, they must be heat treated. Typically, these treatments include solution heat treatment, homogenization, or annealing. During such heat treatment lithium atoms in the vicinity of the surface combine with oxygen to form oxides. In time there is an increased lithium atom vacancy concentration in the interior of the alloy material as lithium atoms diffuse toward the surface forming a gradient. The result is a net motion of vacancies which is a vector quantity having magnitude and direction referred to as a vacancy flux. In vector terms, the vacancy flux added to the aluminum atom flux is equal to the oppositely directed flux of lithium atoms. The existence of the vacancy flux physically creates agglomerated vacancies which resemble internal microscopic pores near the surface where the lithium has been lost. The absence of lithium and the presence of pores diminishes the strength of the alloy.

Certain prior art approaches have attempted to create a protective atmosphere during heat treatment. For example, in published U.K. patent application 2,137,666 A, a carbon dioxide atmosphere having a controlled water vapor partial pressure constitutes the heat treatment atmosphere. A protective atmosphere of this type is considered to decrease the attack rate on lithium atoms due to oxidation. However, as shown in the figure, with a "wet" carbon dioxide atmosphere, a substantial lithium loss still occurs for some distance adjacent the surface. It would be highly desirable to minimize the "rising edge" portion of the plot shown in the figure.

BRIEF DESCRIPTION OF THE PRESENT INVENTION

The present invention is directed toward the coating of an Al-Li alloy material with a coating before heat treatment. The coating consists of a rapidly diffusing element having approximately the same diffusion rate as lithium. Such an element may include (Ag, Au, Zn, Ge, In, Tl, or Sn). By pre-coating the alloy with such an element, the atoms thereof have a flux in an opposite direction to the lithium flux. In an idealized situation, the atoms of the diffusing element prevent the creation of a vacancy flux due to the face that the vacancy concentration remains uniform throughout the sample with no net motion of vacancies. The end result will be the replacement of diffusing lithium atoms with the atoms of the diffusing element.

Thus, the present invention is directed to a coating process during heat treatment whereby the flux of lithium out of the sample is compensated by the opposite flux of the deposited material thus eliminating near-surface porosity. The present coating process is particularly useful for critical structural parts, such as for aerospace vehicles and when a hydrogen atmosphere, as taught by my co-pending application, is impractical or too expensive.

BRIEF DESCRIPTION OF THE FIGURE

The above-mentioned objects and advantages of the present invention will be more clearly understood when considered in conjunction with the accompanying drawing, in which:

the FIGURE is a graphical representation of a lithium concentration within a material heated with a protective atmosphere in accordance with the prior art. The dotted line shows the lithium concentration for the ideal case where there is no loss of lithium. The solid line shows the actual case.

DETAILED DESCRIPTION OF THE INVENTION

Prior to heat treating Al-Li alloy material having a typical lithium concentration of 2.3–2.6 percent, a coating of a rapidly diffusing element is deposited on the exposed surfaces of the alloy material. A typical alloy is industrially identified as alloy 8091. The thickness of the coating should be no less than approximately 5 micrometers; and in a preferred embodiment of the invention, a thicker coating, in the range of 10–20 micrometers, is desirable. The actual coating process may be done by a number of conventional procedures known to those of ordinary skill in the art, including: evaporation, plating, and chemical deposition.

The criterion for selection of the element to be coated onto the surface is that its diffusivity at the heat treatment temperature be approximately equal to, or greater than, that of lithium. This would be $$2\times10^{-9}\ \mathrm{cm^2/s}$$

at 500° C. or $$5\times10^{-9}\ \mathrm{cm^2/s}$$

at 535° C. It is anticipated that appropriate elements include: Ag, Au, Zn, Ge, In, Tl, or Sn. However, these elements do not include the entire group of acceptable elements.

During the heat treatment with the coating, there is a net motion of the diffusing element atoms (away from the surface) in a direction opposite that of diffusing lithium atoms (toward the surface). As a result, there is no vacancy flux vector because the Li flux is compensated by an opposing flux of the plated element.

The physical result will be to reduce the vacancy flux and consequently agglomerated vacancies which would otherwise form interior pores. The absence of material within these pores would otherwise weaken the material. However, this is prevented by the diffusing element which assumes the positions of diffused Li atoms. With the presence of the diffused atoms in lieu of pores, the structural integrity of the material may be maintained.

It should be understood that the invention is not limited to the exact details of construction shown and described herein for obvious modifications will occur to persons skilled in the art.

I claim:

1. A method for suppressing the formation of pores in an Al-Li alloy undergoing heat treatment comprising the steps:

coating an exposed alloy surface prior to heat treatment with an element having a diffusion coefficient equal to or greater than Li at the heat treatment temperature;

subjecting the coated alloy to the preselected heat treatment temperature for a predetermined time wherein a minimized vacancy flux occurs thereby suppressing the formation of internal porosity near the surface.

2. The method set forth in claim 1 wherein the element is chosen from the group including: Ag, Au, Zn, Ge, In, Sn, and Tl.

3. The method set forth in claim 1 wherein the alloy has a normal Li concentration range of 0.5–3.0 percent.

4. A preliminary method for suppressing porosity development of an Al-Li alloy, having a normal Li concentration of 2.3–2.6 percent, and undergoing heat treatment, the method comprising the steps:

coating an exposed alloy surface, prior to heat treatment, with an element chosen from the group Ag, Au, Zn, Ge, In, Sn, and Tl, the coating having a thickness in the range 5–20 micrometers;

subjecting the coated alloy to a preselected heat treatment temperature for a predetermined time wherein a vacancy flux of Li atoms in the alloy is compensated by an opposite flux of atoms of the chosen element.

5. The method set forth in claim 4 wherein the diffusion coefficient of the chosen element is approximately $2\times10^{-9}$ $cm^2/s$ and the heat treatment temperature is 500° C.

6. The method set forth in claim 4 wherein the diffusion coefficient of the chosen element is approximately $5\times10^{-9}$ $cm^2/s$ and the heat treatment temperature is 535° C.

* * * * *

UNITED STATES PATENT AND TRADEMARK OFFICE
CERTIFICATE OF CORRECTION

PATENT NO. : 5,061,328

DATED : October 29, 1991

INVENTOR(S) : John M. Papazian

It is certified that error appears in the above-identified patent and that said Letters Patent is hereby corrected as shown below:

Column 1, line 61, change "face" to --fact--.

Signed and Sealed this

Ninth Day of February, 1993

*Attest:*

STEPHEN G. KUNIN

*Attesting Officer*

*Acting Commissioner of Patents and Trademarks*